US009757286B2

(12) United States Patent
Beaulieu et al.

(10) Patent No.: US 9,757,286 B2
(45) Date of Patent: Sep. 12, 2017

(54) APPARATUS, SYSTEM AND KIT FOR RAPIDLY MOVING A NON-AMBULATORY PERSON AND/OR OBJECT

(71) Applicant: B2 Products, LLC, Tolland, CT (US)

(72) Inventors: Joshua Beaulieu, Tolland, CT (US); Christopher Beaulieu, Hudson, NH (US)

(73) Assignee: B2 PRODUCTS LLC, Tolland, CT (US)

( * ) Notice: Subject to any disclaimer, the term of this patent is extended or adjusted under 35 U.S.C. 154(b) by 188 days.

(21) Appl. No.: 14/555,007

(22) Filed: Nov. 26, 2014

(65) Prior Publication Data

US 2015/0143634 A1 May 28, 2015

Related U.S. Application Data

(60) Provisional application No. 61/908,913, filed on Nov. 26, 2013.

(51) Int. Cl.

| | |
|---|---|
| ***A61G 1/01*** | (2006.01) |
| ***A61G 1/04*** | (2006.01) |
| ***A61G 1/044*** | (2006.01) |
| ***A61G 1/048*** | (2006.01) |

(52) U.S. Cl.

CPC ..... *A61G 1/01* (2013.01); *A61G 1/044* (2013.01); *A61G 1/048* (2013.01)

(58) Field of Classification Search

CPC ..... A61G 1/01; A61G 1/013; A61G 1/048; A61G 1/044; A61G 7/001; A61G 7/1023; A61G 7/1026; A61G 7/1051

See application file for complete search history.

(56) References Cited

U.S. PATENT DOCUMENTS

| | | | | | |
|---|---|---|---|---|---|
| 4,375,111 | A * | 3/1983 | Hall | A47G 9/062 | 190/2 |
| D274,493 | S * | 7/1984 | Dyby | D6/392 | |
| 4,699,132 | A * | 10/1987 | Carville | A61F 5/3776 | 128/876 |
| 4,744,115 | A * | 5/1988 | Marchione | A61G 7/1026 | 5/81.1 T |
| 4,922,562 | A * | 5/1990 | Allred | A61G 1/013 | 128/870 |
| 5,190,056 | A * | 3/1993 | Hull | A61B 6/0442 | 128/870 |

(Continued)

*Primary Examiner* — Eric Kurilla

(74) *Attorney, Agent, or Firm* — Damian Wasserbauer; Wasserbauer Law LLC

(57) ABSTRACT

An apparatus, system and kit for transporting a non-ambulatory person comprising: a sheet assembly for enclosing the non-ambulatory person. The sheet assembly having a generally rectangular shape with sides and ends, a base layer, an upper layer, one or more straps; and a plurality of rigid plates disposed between said base and upper layers functioning to protect the non-ambulatory person being transported by a rescuer(s) from impacts, as these may occur in carrying, dragging, or otherwise moving from one location to another. A kit be configured with a satchel with quantities of sheet assemblies, which also can be varied in different sizes, and placed in the satchel, a drag harness, securing straps, and additional trauma supplies as may be required in a rescue operation.

19 Claims, 9 Drawing Sheets

(56) References Cited

U.S. PATENT DOCUMENTS

| | | | | | |
|---|---|---|---|---|---|
| 5,210,891 | A * | 5/1993 | Avital | A45C 3/10 | 224/156 |
| 5,214,813 | A * | 6/1993 | Gastle | A61G 1/01 | 5/625 |
| 5,263,213 | A * | 11/1993 | Robertson | A61G 1/00 | 5/601 |
| 5,386,604 | A * | 2/1995 | Ricketts | A61G 1/01 | 5/413 R |
| 5,442,821 | A * | 8/1995 | Weeks | A61G 1/01 | 5/627 |
| 5,577,281 | A * | 11/1996 | Mital | A61G 1/01 | 5/625 |
| 5,978,989 | A * | 11/1999 | Chavez | A61G 1/01 | 294/140 |
| 7,065,814 | B2 * | 6/2006 | Rutkowski | A47D 5/006 | 128/876 |
| 8,096,008 | B1 * | 1/2012 | Phillips | A61G 1/013 | 128/870 |
| 8,615,829 | B2 * | 12/2013 | Kenalty | A61G 1/013 | 5/625 |
| 9,283,129 | B1 * | 3/2016 | Pifer | A45F 4/06 | |
| 2002/0162171 | A1 * | 11/2002 | Faz | A61G 1/017 | 5/627 |
| 2009/0038076 | A1 * | 2/2009 | Giduck | A61G 1/01 | 5/627 |
| 2010/0203780 | A1 * | 8/2010 | Hobbs | B63C 9/26 | 441/80 |
| 2011/0265263 | A1 * | 11/2011 | Bartholomew | A61G 1/01 | 5/627 |
| 2013/0180046 | A1 * | 7/2013 | Davis, Jr. | A61G 7/1074 | 5/81.1 HS |

* cited by examiner

APPARATUS, SYSTEM AND KIT FOR RAPIDLY MOVING A NON-AMBULATORY PERSON AND/OR OBJECT

This patent application claims priority to U.S. Provisional Patent Application Ser. No. 61/908,913 entitled "APPARATUS SYSTEM AND METHOD FOR MOVING A NON-AMBULATORY PERSON" filed on Nov. 26, 2013, and the entire disclosure is hereby incorporated by reference herein.

FIELD OF THE INVENTION

The present invention relates generally to rescue and/or evacuation devices and, more particularly, to an apparatus, system and kit for moving a non-ambulatory person rapidly and securely enclosed to a safe location over land including rugged terrain.

BACKGROUND OF THE INVENTION

Evacuation sleds are used by first responders, emergency services, care facilities, etc, to rapidly and safely evacuate patients from beds, accidents, danger zones, and the like. Typically, the sled is brought to the non-ambulatory person; the person is transferred to the sled, and then evacuated by pulling or dragging. One apparent disadvantage of conventional sleds is being configured for multiple persons to move the non-ambulatory person, whereby an efficient evacuation sled is desired to be deployed and used by a single first responder.

Conventional evacuation sleds and devices may be characterized as a "soft" sled or a "hard" sled. Known soft sleds are devices formed from plastic, cloth or other flexible materials for evacuating and transporting a non-ambulatory person. For example, U.S. Pat. No. 4,442,557 issued Apr. 17, 1984 to Clemens discloses a soft carrier apparatus for use by fire fighters to carry fire hose, and then to serve as a personnel carrier, configured with bottom and side walls, and at one end there is an end wall having handles and portions of the side walls the end wall perpendicular to the bottom and end wall. While useful, such conventional soft sleds have disadvantages in that a non-ambulatory person can be further injured because the soft sheet of material does not protect from jagged surfaces, falls, impacts, or other external forces that may affect the person during transportation. A further not obvious problem with soft sleds is the difficulty in a single person reliably and securely transporting the non-ambulatory person, as they may roll out or have their weight shift complicating transporting them.

Similarly, conventional hard sleds are devices formed from a rigid board from wood, plastic or other materials with hand-holds or cut-outs for the responder to use when transporting and evacuating non-ambulatory person. Conventional hard sleds also have belts or ropes to be put around the person to secure the person to the sled while transporting. For example, U.S. Pat. No. issued Feb. 5, 2013 to Kenalty et al. discloses a hard sled for use in evacuating or moving non-ambulatory persons comprising a sled formed of a semi rigid plastic sheet preferably made of a sheet of high density polyethylene (HDPE), although any suitable material may be used, such as Kevlar, composites, resins, other high density plastics, etc. While useful, conventional hard sleds have disadvantages in that these may be relatively expensive to buy, bulky and therefore difficult to store or transport, difficult for one person to maneuver and use reliably when the non-ambulatory person is placed thereon, and are not foldable.

What is desired, then, is a low cost efficient and effective apparatus, system and kit for moving a non-ambulatory person with improvements over the problems and disadvantages of conventional soft and hard sled designs. A problem to be addressed by the design of the present invention is to provide an apparatus, system and kit for a single person to securely and reliably transport a non-ambulatory person while protecting them from further injury during transport.

For example, a disadvantage that is not obvious is that dragging the non-ambulatory person across a rough surface using conventional soft sleds, such as concrete, may further injure the non-ambulatory person placed thereon. The design apparatus, system and kit of the present invention addresses this problem to protect the non-ambulatory person being moved by having one or more protective rigid plates or plates disposed therein. The one or more protective plates in the design of the apparatus, system and kit of the present invention is an improvement over conventional soft sleds that protects non-ambulatory persons from further injury by while being moved.

Another problem to be addressed by the apparatus, system and kit of the present invention is for a single person to deploy and to transport securely a non-ambulatory person. A disadvantage that is not obvious is that conventional sleds have designs where a single person has problems transporting a non-ambulatory person when using them.

A disadvantage that is not obvious is that conventional sleds have designs that delay the process of deployment and transportation of a non-ambulatory person. Soft sleds are rolled and ineffective so as to cause deployment delays; hard sleds are heavy and not easily transported causing deployment delays. The present invention has a system that may be formed in a portable kit design with advantages to transport one or more sleds easily to the site of the non-ambulatory person(s) so as to deploy and transport one or more non-ambulatory persons. The kit may be configured in a satchel, backpack or other carrying case and one or more devices disposed within the pack is carried by a person, for example, in a pack or backpack of a first responder. In operation, the design of the present invention also is folded in a z-fold to quickly deploy by a single person or first responder, e.g. by removing from the case, positioning adjacent the non-ambulatory person, tossing forward while holding the handles so as to deploy, then moving the non-ambulatory person onto it (and securing thereto), and transporting the non-ambulatory person from one location to another.

As a result of these and other problems and disadvantages, there exists a long-felt need for a solution of the apparatus, system and kit in a portable, flexible sled with one or more protective plates designed to be easily transported to the non-ambulatory person, deployed, and utilized by a single first responder. The apparatus, system and kit of the present invention is designed to protect the non-ambulatory person being moved by having one or more protective plates disposed therein. There also exists a need for a portable kit design configured with one or more devices disposed within a backpack used by a person (e.g. first responder, emergency medical technician, police, fire, rescue, etc.) that advantageously may be transported to the site of the non-ambulatory person and deployed so as to transport one or more non-ambulatory persons.

The present invention satisfies these and other long-felt needs to deploy and move one or more non-ambulatory person from one location to another. The sled design of the present invention has straps used in transporting by two (2) or more persons, or by one (1) person using such straps as a harness for dragging the non-ambulatory person and protecting them from further injury by the one or more protective plates disposed therein while being moved.

SUMMARY OF THE INVENTION

It is an object of the present invention to provide an efficient and effective apparatus, system and kit for moving a non-ambulatory person without further injury thereto.

It is an object of the present invention to provide an apparatus, system and kit adapted to be efficiently packed having one or more devices in a pack and carried by a person, for example, in a satchel or backpack of a person or first responder.

It also is an object of the present invention to provide an apparatus, system and kit adapted to be quickly deployed so as to move any non-ambulatory person by one or more ambulatory persons for the purpose of moving them from one location to another.

It is yet another object of the present invention to provide an apparatus, system and kit that accommodates movement by carrying by two (2) or more persons, or dragging by one (1) or more persons.

It is another object of the apparatus, system and kit present invention to protect the non-ambulatory person being moved by having one or more protective plates disposed therein.

BRIEF DESCRIPTION OF THE DRAWINGS

Non-limiting and non-exhaustive embodiments of the present invention are described with reference to the following drawings. In the drawings, like reference numerals refer to like parts throughout the various figures unless otherwise specified.

For a better understanding of the present invention, reference will be made to the following Description of the Embodiments, which is to be read in association with the accompanying drawings, which are incorporated in and constitute a part of this specification, show certain aspects of the subject matter disclosed herein and, together with the description, help explain some of the principles associated with the disclosed implementations, wherein.

DESCRIPTION OF THE EMBODIMENTS

Figure 1:
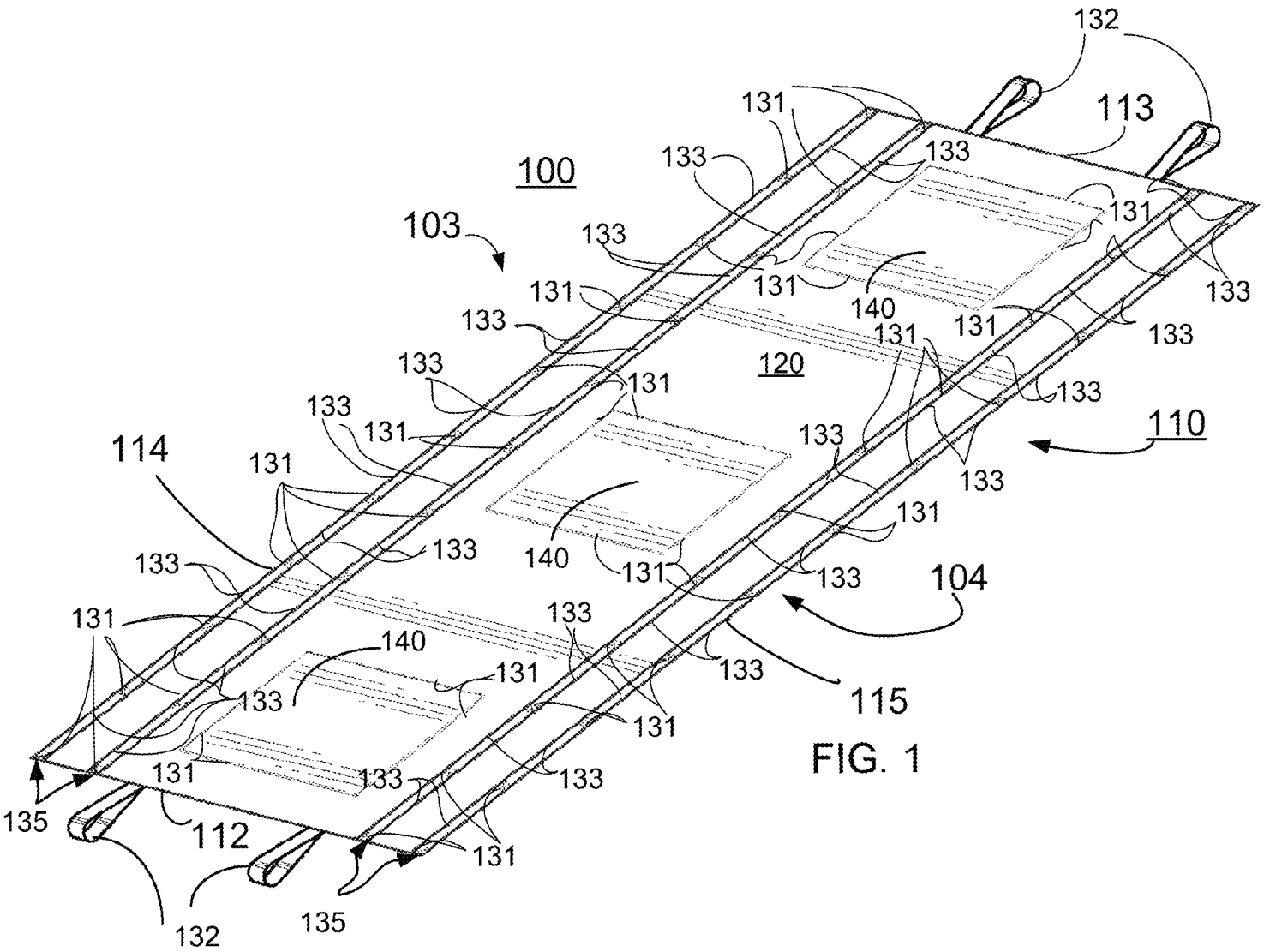
FIG. 1 is a perspective of the portable apparatus, system and kit in accordance with an embodiment of the present invention.

Non-limiting embodiments of the present invention will be described below with reference to the accompanying drawings, wherein like reference numerals represent like elements throughout. While the invention has been described in detail with respect to the preferred embodiments thereof, it will be appreciated that upon reading and understanding of the foregoing, certain variations to the preferred embodiments will become apparent, which variations are nonetheless within the spirit and scope of the invention.

The terms "a" or "an", as used herein, are defined as one or as more than one. The term "plurality", as used herein, is defined as two or as more than two. The term "another", as used herein, is defined as at least a second or more. The terms "including" and/or "having", as used herein, are defined as comprising (i.e., open language). The term "coupled", as used herein, is defined as connected, although not necessarily directly, and not necessarily mechanically.

Reference throughout this document to "some embodiments", "one embodiment", "certain embodiments", and "an embodiment" or similar terms means that a particular feature, structure, or characteristic described in connection with the embodiment is included in at least one embodiment of the present invention. Thus, the appearances of such phrases or in various places throughout this specification are not necessarily all referring to the same embodiment. Furthermore, the particular features, structures, or characteristics may be combined in any suitable manner in one or more embodiments without limitation.

The term "or" as used herein is to be interpreted as an inclusive or meaning any one or any combination. Therefore, "A, B or C" means any of the following: "A; B; C; A and B; A and C; B and C; A, B and C". An exception to this definition will occur only when a combination of elements, functions, steps or acts are in some way inherently mutually exclusive.

The drawings featured in the figures are provided for the purposes of illustrating some embodiments of the present invention, and are not to be considered as limitation thereto. Term "means" preceding a present participle of an operation indicates a desired function for which there is one or more embodiments, i.e., one or more methods, devices, or apparatuses for achieving the desired function and that one skilled in the art could select from these or their equivalent in view of the disclosure herein and use of the term "means" is not intended to be limiting.

As used herein the term "R.P.M." "RPM" "Rapid Patient Mover" or "rapid mover apparatus and system" refers to an apparatus, system and method for moving a non-ambulatory person. As used herein "non-ambulatory person," "patient" or "victim" refers to a person, individual or object that needs to be moved using the sheet assembly 110 of the present invention apparatus and system 100. The terms "ambulatory person" "person" or "rescuer" mean the individual person that is expending effort to move the patient using the sheet assembly 110 of the present invention apparatus and system 100. Depending on the condition of the non-ambulatory person to be treated, one having ordinary skill in the relevant art will be able to determine if and/or how a particular person will place the non-ambulatory person into the rapid mover apparatus and system 100 and/or utilize kit 160 to achieve the desired transportation effect.

As used herein the term "Plate" in the description of the apparatus, system and method for moving a non-ambulatory person refers to a rigid and/or semi-ridged plate of suitable pre-determined dimensions and shape. The plate is made from firm, flexible, waterproof, bendable, durable, shatter-proof or otherwise impact resistant materials, for example, thermoplastics that bend but do not snap or crack when impacted under stresses where the weight of a non-ambulatory person being transported, carried or dragged does not crack the material. In the present invention, the material can be thermoplastics of ⅛ inch thickness.

As used herein, the term "Folding" in the description of the apparatus, system and method for moving a non-ambulatory person refers to a pre-determined folding whereby the features enable easily unfolding by an ambulatory person by (1) holding at one end and tossing outwardly to quickly unfold, then load and transport the non-ambulatory person; (2) placing under the non-ambulatory person's head and pulling underneath them; or (3) other efficient action depending on the condition of the non-ambulatory person to be treated, one having ordinary skill in the relevant art will be able to determine if and/or how a particular person will place the non-ambulatory person into the rapid mover apparatus and system 100 and kit 160 to achieve the desired transportation effect.

As used herein the term "joining" refers to joining individual assemblies 110, 111, 120, 130, 135, and 140 such as by stitching, seams or hems using least a single loop of thread or yarn, whether by hand or machine zippers, fusion, or other means to attach such individual assemblies together.

As used herein the term "stitch" refers to at least a single loop of thread or yarn, whether by hand or machine, as is known in the textile arts including a blanket stitch, used to reinforce the edge of thick materials, cable knitting, chain stitch, cross-stitch, embroidery stitch, lockstitch, overlock, or barter stitch used to form welting, or stitches using one or more threads (e.g. Chain stitch, made with one thread, Lockstitch, made with two threads, Overlock, made with one to four threads, and Coverstitch, made with two or four threads).

As used herein the term "seam" refers to join, in sewing, two or more layers of fabric, leather, or other materials together and held with stitches, e.g. one or more stitches in an elongated line (e.g. straight, zig-zag, arcuate, etc.) joining such individual assemblies 110, 120, 130 and 140 by hand or by machine, as is appropriate, for example, to stitch together by a seam.

As used herein the term "hem" or "hemmed" refers to seeming in the garment finishing stage one or more stitches in an elongated line (e.g. straight, zig-zag, arcuate, etc.), for example, joining such individual assemblies 110, 120, 130 and 140 on all sides with a 1" hem. There are many different styles of hems of varying complexities that may be performed by hand or by machine, as is appropriate. An overcast stitch may be used to form a simple hem and encloses the edge of fabric without any folds. A standard hem folds up a cut edge, folds it up again, and then sews it down so as to completely enclose the cut edge in cloth, so that it cannot unravel.

As used herein the term "satchel", "sack", "backpack" or "pack" refers to a pocketed enclosure fitted with handles or a drag harness for transporting one or more apparatus, system and kit. The pack or back pack is a pocketed enclosure for transporting one or more sheet assemblies 110 of the apparatus, system and kit 100 and is designed to distribute the weight of its contents across the body more appropriately, by transferring much of the weight to the hips and legs, i.e. a backpack (also called rucksack, knapsack, or bergen) is, in its simplest form, a sack carried on one's back and secured with two straps that go over the shoulders and are sometimes worn on only one shoulder strap.

Figure 12:
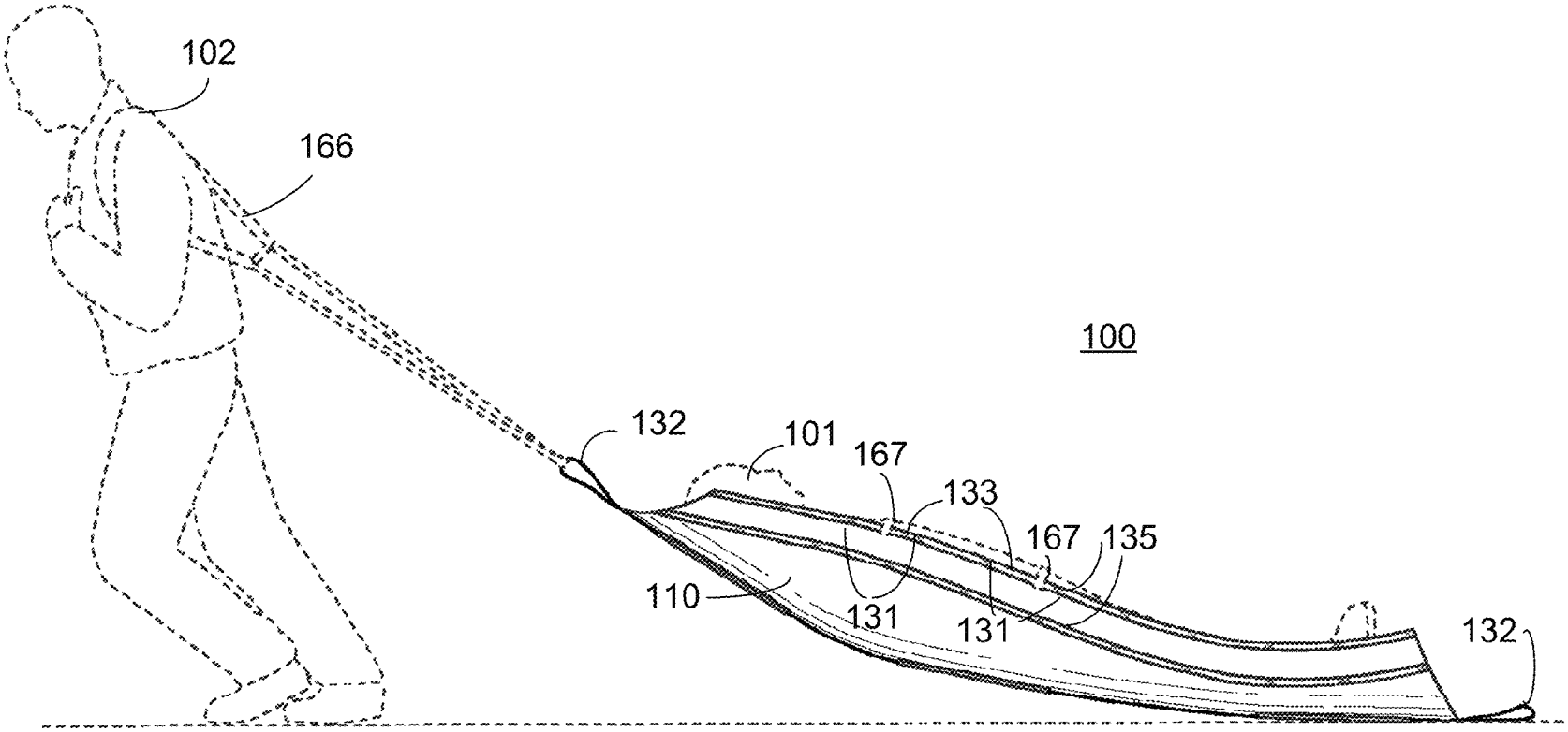
FIG. 12 is a perspective view of the operation of a person transporting a load on the rapid mover apparatus, system and kit in accordance with an embodiment of the present invention.
Figure 13:
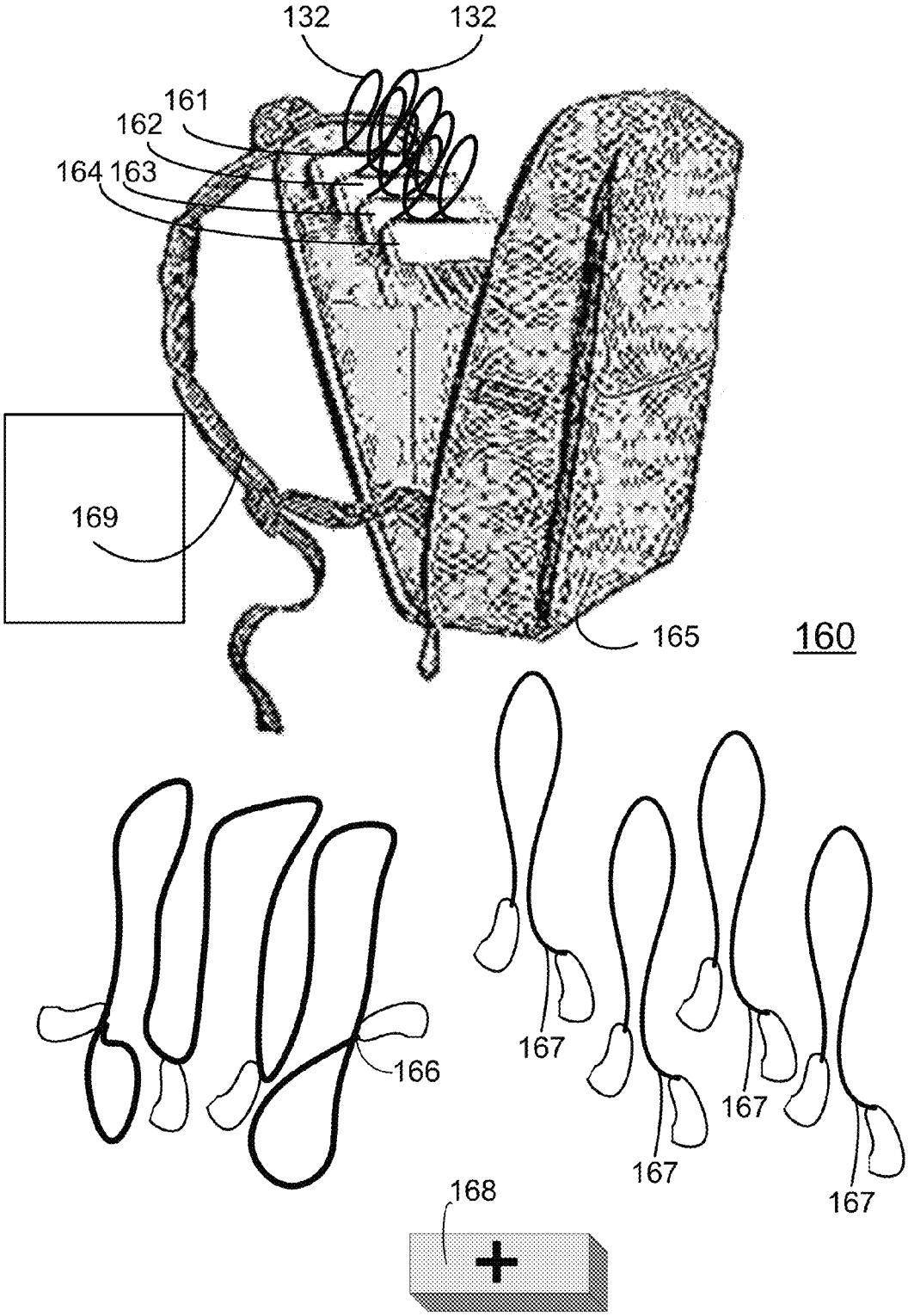
FIG. 13 is a perspective side view illustrating the kit in accordance with an embodiment of the present invention.

As is illustrated in FIGS. 1 through 13, an apparatus and system 100 is configured according to one embodiment of the present invention shown in FIG. 1 and generally designated 100. The apparatus and system 100 is described in an embodiment of transporting a non-ambulatory person, patient, animal or object 101 by an ambulatory person or rescuer 102 as is illustrated in FIG. 12. The apparatus 100 can be configured in a predetermined dimension to accommodate adult individuals; however, the dimensions (i.e. a dimension of 80"×36") may be varied without departing from the spirit and scope of the present invention. For example, a slightly larger version may be constructed from heat resistant material for use in rescuing firefighters in distress in a structure fire environment. Moreover, a version in a smaller predetermined dimension may be constructed suitable for rescuing animals such as, for example, injured search or police dogs. Additionally, as shown in FIGS. 12 and 13, a kit 160 according to the present invention advantageously may be formed with a plurality of the apparatus and system 100 assembled to be deployed in a portable backpack 165.

As is illustrated in FIGS. 1 through 13, a sheet assembly 110 includes a base layer 111, an upper layer 120, a plurality of integral straps 130, a plurality of securing straps 135 on the top 103 and bottom 104 surfaces, and a plurality of plates 140. The base layer 111 and upper layer 120 may be formed from synthetic fabrics and may be coated or uncoated. Accordingly the present invention is described in an embodiment having the base layer 111 and upper layer 120 configured with a coated surface operating to improve wear, become waterproof or otherwise impregnable to liquids, and to be cleaned easily, for example, natural or synthetic fabrics that are coated or laminated with a waterproofing material such as rubber, polyvinyl chloride (PVC), polyurethane (PU), silicone elastomer, fluoro-polymers, and wax. The plates 140 function to protect the patient 101 being transported by the rescuer(s) 102 from impacts, as these may occur in carrying, dragging, or otherwise moving the patient 101 from one location to another. A kit 160 according to the present invention may be configured with quantities of sheet assembly 110, as identified in FIG. 13 as sheet assemblies 161, 162, 163 and 164, that can be varied in different sizes and quantities and placed in the backpack 165 with drag harness 166, securing straps 167, and additional trauma supplies 168 as may be required in a rescue operation. In an alternative embodiment, the integral harness 169 of the backpack 165 may replace the kit 160 drag harness 166 and utilized for transporting the patient 101 from one location to another.

Figure 2:
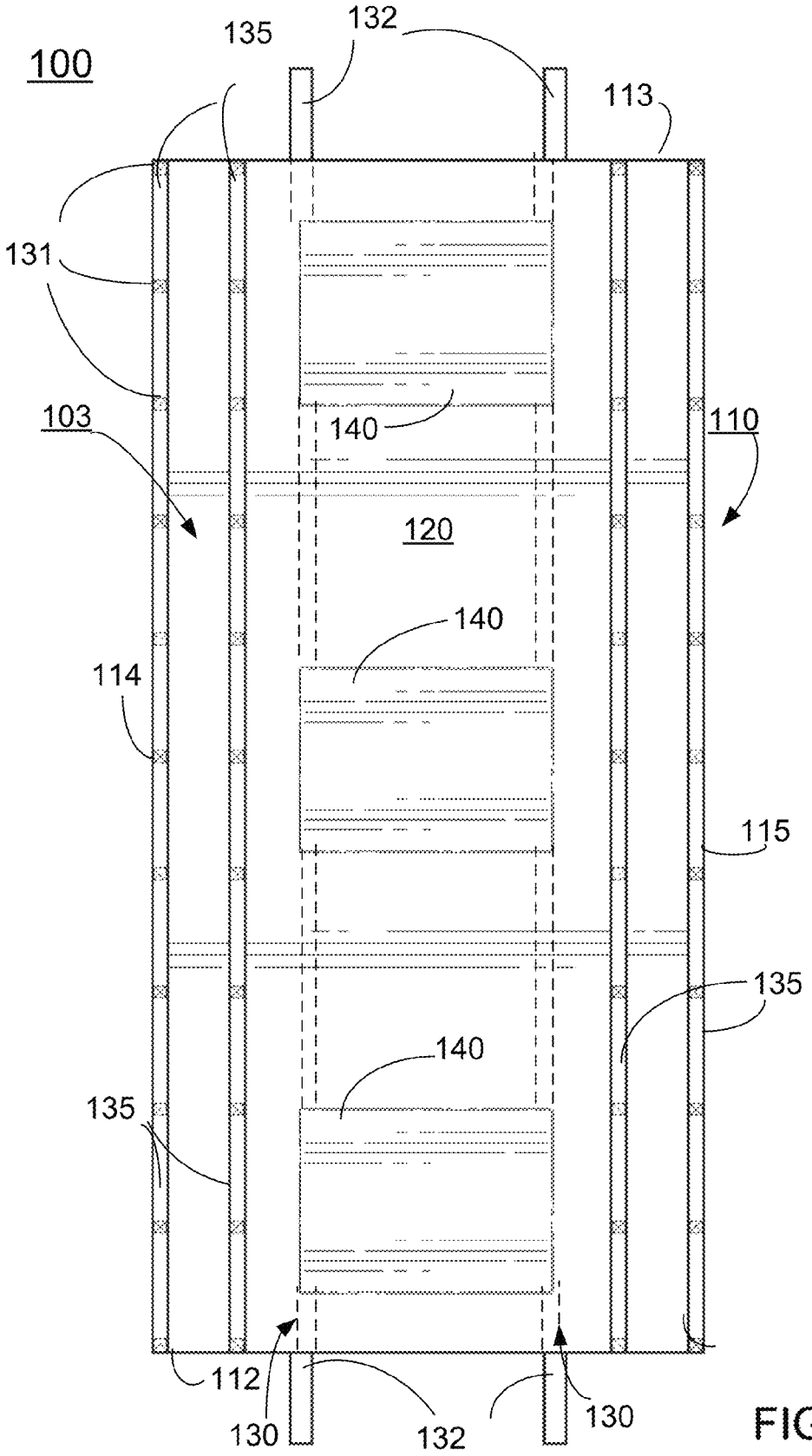
FIG. 2 is a top view of the apparatus, system and kit.
Figure 3:
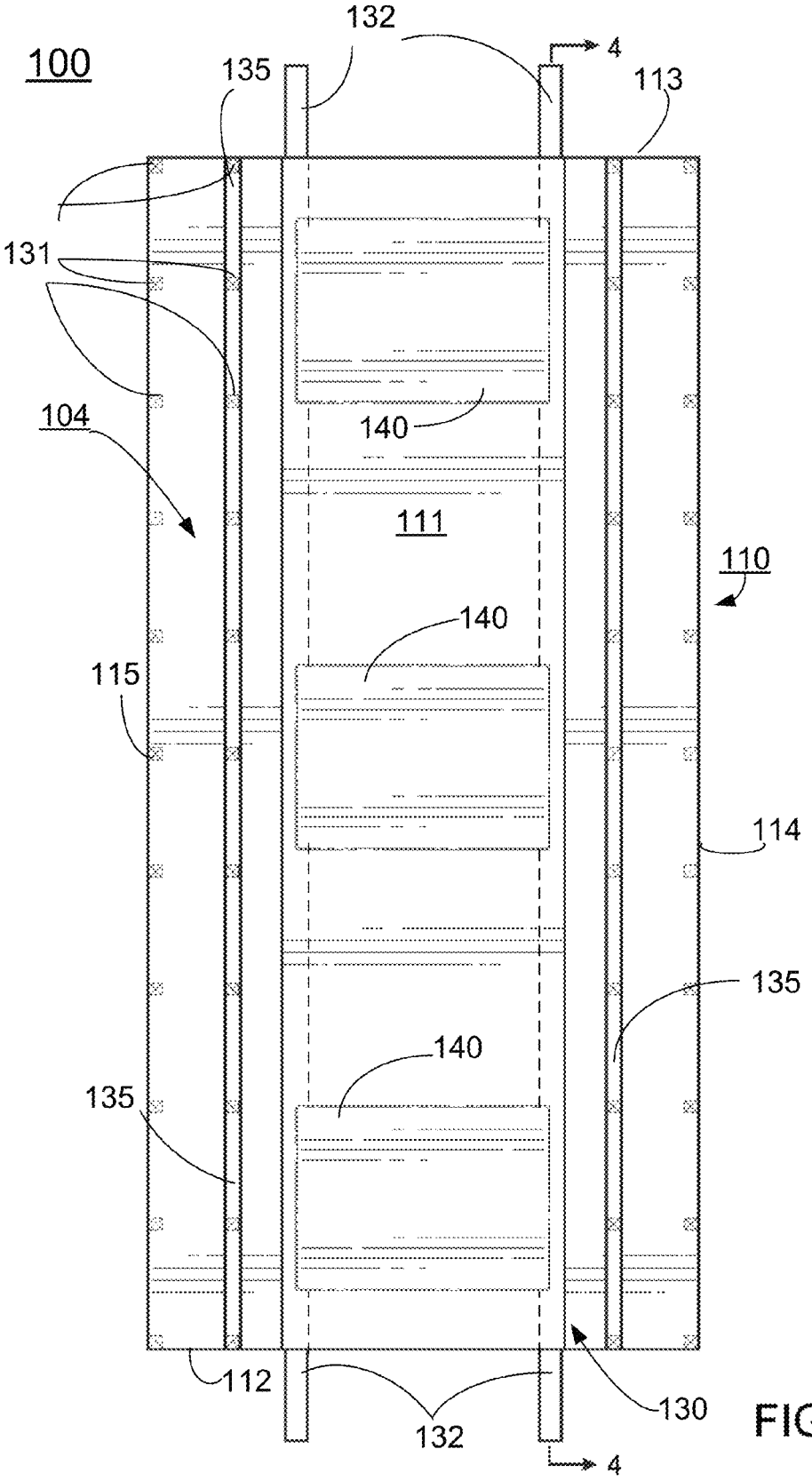
FIG. 3 is bottom view of the apparatus, system and kit.
Figure 4:
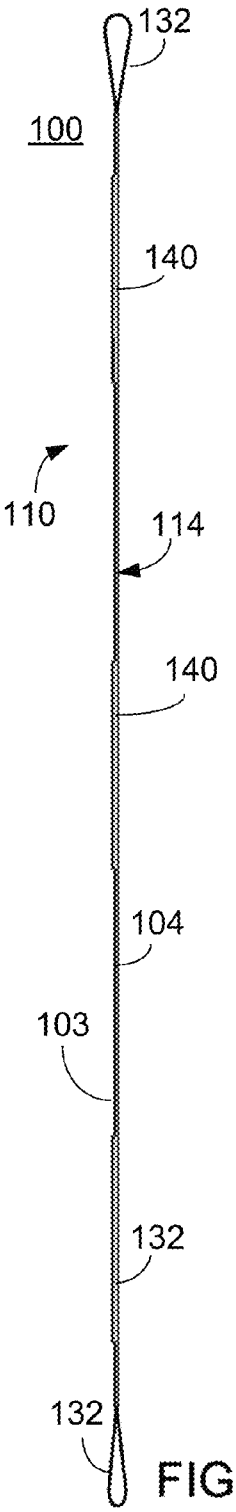
FIG. 4 is a side view of the apparatus, system and kit.
Figure 5:
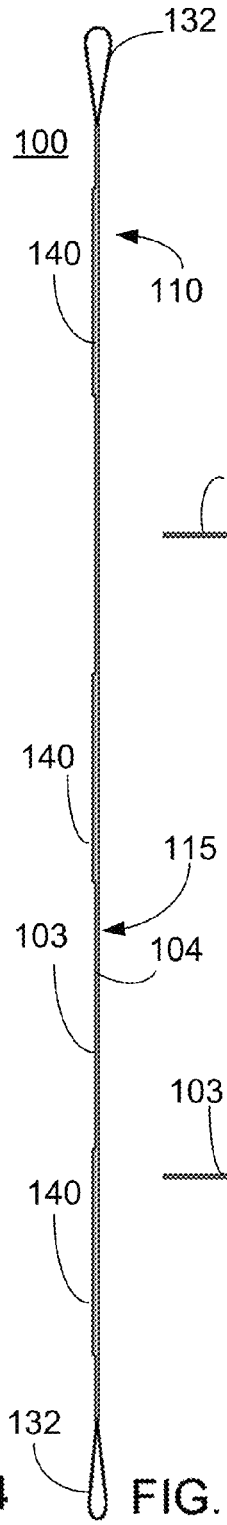
FIG. 5 is a side view of the apparatus, system and kit.
Figure 6:
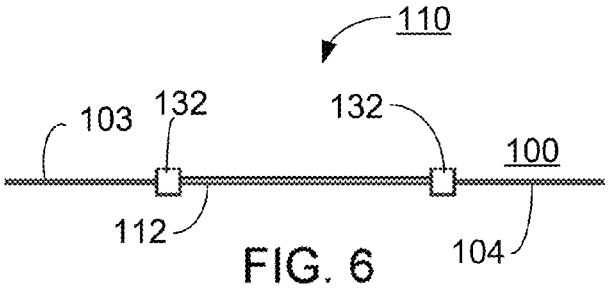
FIG. 6 is a end view perspective of the apparatus, system and kit.
Figure 7:
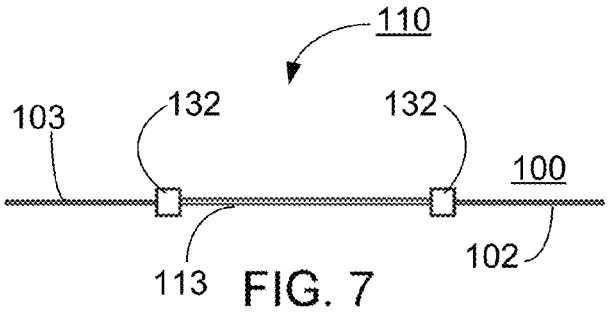
FIG. 7 is a end view perspective of the apparatus, system and kit.
Figure 8:
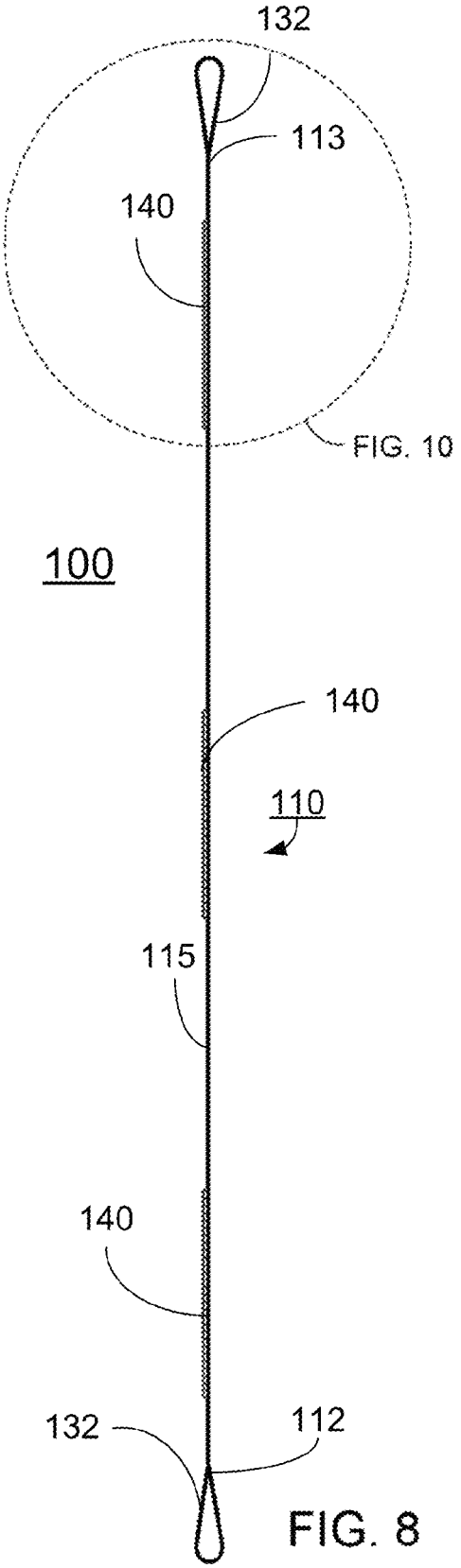
FIG. 8 is a perspective side, cross-sectional view, taken along lines 4-4 of FIG. 3 FIG. 3, illustrating the fabric and plate construction of the apparatus, system and kit in accordance with an embodiment of the present invention.
Figure 9:
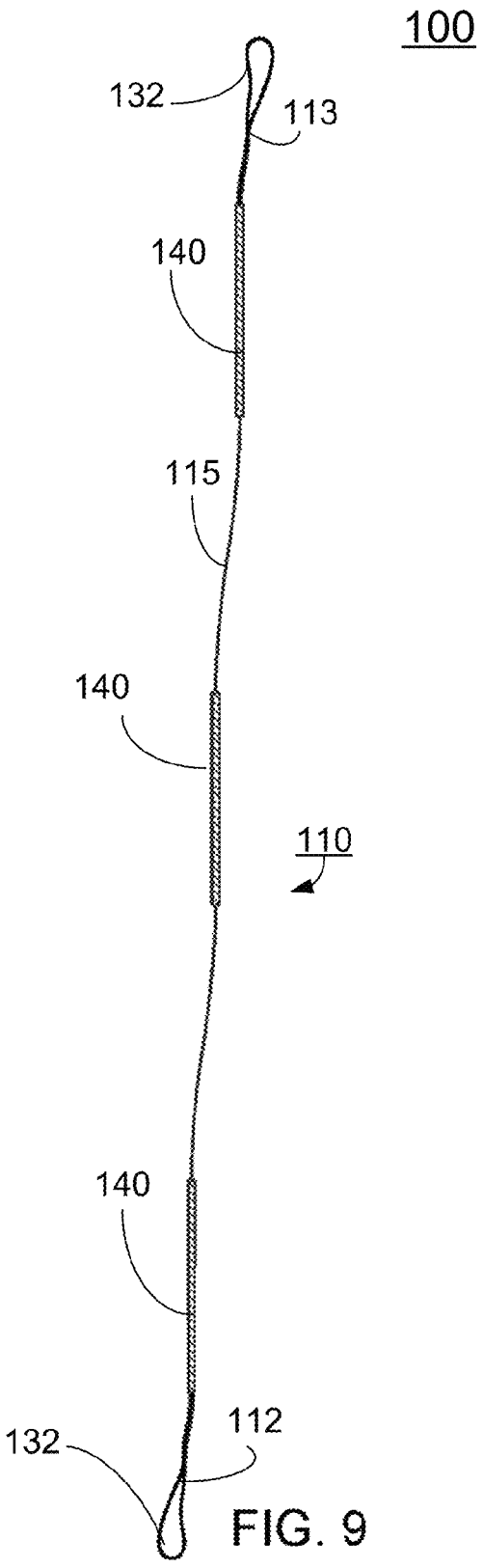
FIG. 9 is a perspective side, cross-sectional view, cross-sectional view, taken along lines 4-4 of FIG. 3, illustrating the flexibility of the fabric and plate construction of the apparatus, system and kit in accordance with an embodiment of the present invention.

As is illustrated in FIGS. 1, 2 and 3, the base layer 111 and upper layer 120 may form in a generally rectangular shape, with respective ends 112, 113 and sides 114, 115. The generally rectangular shape may have a suitable predetermined dimension so as to transport a patient 101 or object 104. By way of non-limiting example, the base layer may have a predetermined dimension of 80 inches (length 80") by 36 inches (width 36"). While preferable to be coated ballistic nylon, the base layer 111 may further be configured with a coated surface rather than an uncoated surface of ballistic nylon. The coated surface may be formed from a urethane coating that impregnates the fibers of the ballistic nylon sheet material and form a liquid barrier (i.e. waterproofing). The liquid barrier functions to protect rescue rescuers from bodily fluids, the patient from environmental liquids (such as water, oil, etc), and to improve wear of the surface from repeated use. The opposite surface of the base layer 111 is an uncoated surface configured to be disposed on an interior of the assembly 110 adjacent a plate 140.

In the construction of the apparatus and system 100 in a sheet assembly 110, the material for the base layer of material 111 may be fabrics, synthetic fibers and other suitable material such as, for example, ballistic nylon. Suitable material(s) for the base layer of material 111 has the properties of high shear strength, and resistance to abrasion and puncture. The base layer 111 may be formed in sheets of coated ballistic nylon and cut to a predetermined dimension. The base layer 111 suitable material is 1680 or 1050 Denier CORDURA® ballistic nylon fabric available as 1050 Denier CORDURA® Ballistic fabric at (http://www.cordura.com/documents/CORDURA_Brand_Fabric_Technologies-Ballistic.pdf) under Product ID 715.

The material for the upper layer 120 may be formed from materials such as fabrics, synthetic fibers other suitable material such as, for example, coated ballistic nylon. The coated ballistic nylon upper layer 120 has the properties of high shear strength, resistance to abrasion and puncture, and easy cleaning. The upper layer 120 may be formed in sheets of ballistic nylon and cut to a predetermined dimension. By way of non-limiting example, the base layer may have a predetermined dimension of 80 inches (length 80") by 36 inches (width 36"). Similarly, suitable material for the upper layer 120 is 1680 or 1050 Denier CORDURA® ballistic nylon fabric (http://www.cordura.com/documents/CORDURA_Brand_Fabric_Technologies-Ballistic.pdf) under part number Product ID 715. The upper layer 120 may also be formed with a coated surface, for example, a urethane coating to form a liquid barrier (i.e. waterproofing to protect rescuers from bodily fluids, or patients from environmental liquids (e.g. water, oil, etc.), and to protect the surface in repeated use). Similarly, the opposite surface of the upper layer 120 is a coated surface, configured to be disposed on an interior of the assembly 110 adjacent a plate 140.

The one or more integral straps 130 can be formed to attach to the sheet assembly 110 at one or more stitching points 131. The one or more large integral straps 130 may be formed from materials such as nylon 2" polyester "seatbelt" webbing and manufactured in various configurations, for example, bands, reinforced tape, ribbon, woven straps, or the like. The webbing materials of the large integral straps 130 may be cut to a predetermined dimension. The integral straps 130 have the properties of durability and high tensile strength for the rated load. High performance tape or webbing is a suitable material for the integral straps 130 and two inch (2") dimension webbing is available from Bally Ribbon Mills (http://www.ballyribbon.com/) and/or American Cord & Webbing (http://www.acwl.com/) in various dimensions, materials, and construction.

The one or more straps 135 also can be formed to attach to the sheet assembly 110 at one or more stitching points 131. The stitching points 131 form loops 132 that may be utilized to secure the patient 102 (e.g. securing ropes thereto) or to grab as a handle by the rescuer 102 advantageously on either side of the base layer 111 or upper layer 120 in the process of transporting (e.g. 40 carrying handles in total attached at various stitching points 131). The one or more straps 135 may be formed from materials such as nylon webbing in a dimension of 1" and manufactured in various configurations, for example, bands, reinforced tape, ribbon, woven straps, or the like. The nylon webbing may be cut to a predetermined dimension. The straps 135 have the properties of durability and high tensile strength. The suitable material for the straps 135 available from Bally Ribbon Mills (http://www.ballyribbon.com/) and/or American Cord & Webbing (http://www.acwl.com/) in various dimensions, materials, and construction.

The plurality of plates 140 may be formed from rigid and/or semi-rigid materials, e.g. metallic or plastic materials such as Polypropylene Copolymer Sheet 0.125" thickness. A suitable predetermined dimension of 0.125" thickness twelve inches in (12") width by sixteen inches (16") length for the one or more plates 140. The Polypropylene Copolymer Sheet may be cut to such predetermined dimension and has properties of being waterproof and having flexible strength. The material for the one or more plates 140 is available in sheets of Polypropylene Copolymer from Interstate Plastics330 Commerce Circle, Sacramento, Calif. 95815 (https://www.interstateplastics.com) under part number PROBEQ.

Figure 10:
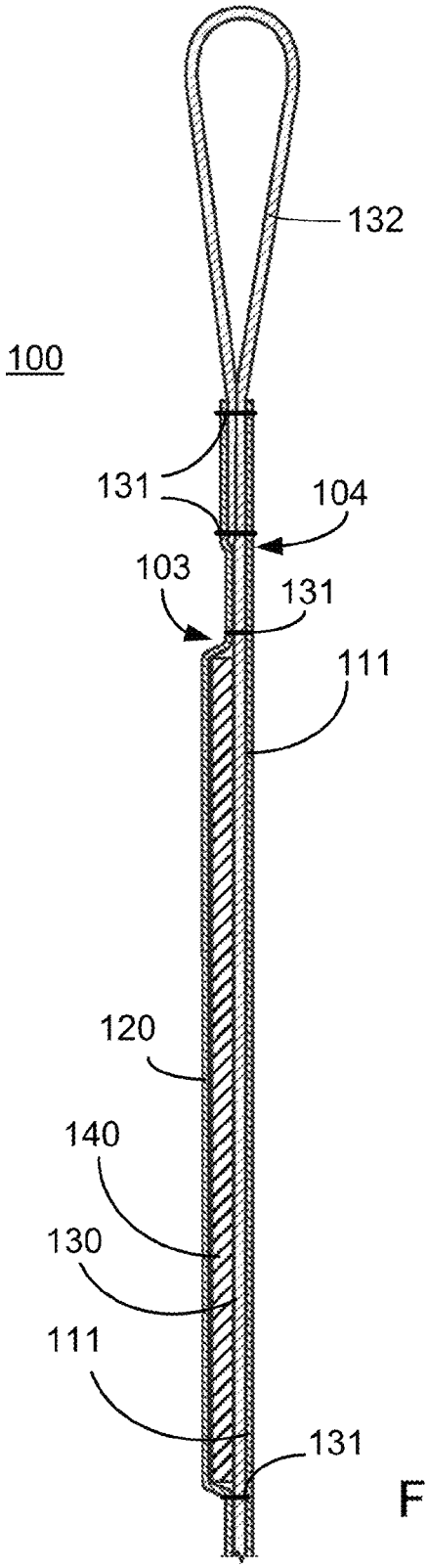
FIG. 10, taken along lines 10 in FIG. 8, is a perspective side, cross-sectional view illustrating the fabric and plate construction of the apparatus, system and kit in accordance with an embodiment of the present invention.

According to one embodiment, the assembly 100 of present invention may be constructed from a solid piece of Coated Ballistic Nylon forming a base layer 111 having a predetermined dimension with ends 112 of a width of 36" and sides of a length of eighty-inches 80". The base layer 111 is also may be formed slightly larger so as to accommodate a one inch (1") hem on all ends 112 and sides 113 so as to have a finished dimension of 80" in length by 36" in width. As above, in one embodiment, the base layer 111 has a coated surface and an uncoated surface, whereby in forming the plate an orientation of the base layer 111 material is to face the uncoated surface out so that all hems are rolled over to the coated surface placing the uncoated surface on the inside adjacent the one or more plates 140 as is shown in FIG. 10. In another step of the construction of the sheet assembly 110, the integral straps 130 may be formed from woven nylon (e.g. woven fabric of warp and weft yarns which are combined to constitute a woven base which extends in a given way such as useful in seatbelt straps for automobiles).

The integral straps 130 may be formed in a predetermined dimension of two-inch (2") straps, which are placed and sewn to the coated surface of the base layer 111. The integral straps 130 are dimensioned of a predetermined length so as to run the entire length of the base layer 111 with additional length on either end to from the handles 132, e.g. eighty inches (80") of length plus twelve inches (12") additional strap material on each end (12"×2=24") so as to secure back to itself of and form handles 132 of approximately six inches (6"). The integral straps 130 are positioned on the base layer 111 generally parallel to one another and spaced apart approximately nine-inches (9") from the respective edge of each side 114 and 115, e.g. so that the outer edge of each strap 130 is 9" from the side 114, 115 edge of the base layer 111, respectively. In such a construction, the inside edges of the strap 10 are spaced fourteen-inches (14") apart.

The one or more semi-rigid plates 140 are placed on the two-inch (2") straps. The one or more semi-rigid plates 140 may be formed in a predetermined dimension of twelve inches in (12") width by sixteen inches (16") length. These one or more semi-rigid plates 140 are oriented so as to be placed on the integral straps 130 having approximately one-inch (1") of the plate 140 covering each strap 130. According to another measurement from one end 112 to the other end 113: one edge of the plate 140 is oriented and placed four inches (4") from the end 112 of the base layer and ends sixteen inches (16") from the end 112, a second plate 140 is placed thirty four inches (34") from end 112 and end 113, and the third plate 140 is oriented and placed four inches (4") from the end 113 resulting in spacing of eighteen inches 18" between each of the first, second, third plate 140.

Accordingly, the assembly 100 uses coated ballistic nylon sheets forming the upper layer 120 having a predetermined dimension with ends 112 of a width of 18" and sides of a length of eighty-inches (80"). The upper layer 120 also may be formed slightly larger so as to accommodate a one inch (1") hem on all ends 112 and sides 113 so as to have a finished dimension of 80" in length by 18" in width. The upper layer 120 of such predetermined dimension (e.g. 80" length by 18" width) may be oriented and placed over the base layer 120 so as to cover two inch (2") integral straps 130 and the semi-rigid plates 140 and the upper layer 120 is sewn to each of the two inch (2") strap(s) 130. The upper layer 120 may be sewn across the width of the material and through the base layer at the following approximate distances measured from either end: 3.5", 16.5", 33.5", 46.5", 63.5", and 76.5" so as to provide sufficient strength as well as to allow for the apparatus, system and kit 100 to fold as shown in FIG. 10. In an alternative embodiment of the present invention, the upper layer 120 may further be configured with a coated surface and an uncoated surface, whereby coated surface of the upper layer 120 is placed against the plates 140 and integral straps 130.

Accordingly, the assembly 100 may be formed of a construction using straps 135 of a predetermined dimension such as, for example, one inch (1") straps 135 formed from high tensile strength nylon tape. The assembly 100 may utilize a construction having four (4) rows of straps 135 on the top 103 where the patient 101 is secured, as shown in FIGS. 1, 2 and two (2) rows of straps 135 on a bottom 104 of the apparatus 100. Each of the four (4) rows on the upper surface is of a dimension of eighty inches (80") in length. Each of the two (2) rows on the bottom is of a dimension of eighty inches (80") in length.

The straps 135 may be secured by sewing, e.g. by a one inch 1" wide stitch pattern in 11 equally spaced stitching point 131 locations, resulting in creating ten (10) loops 133 approximately 6.75" long spaced equally between each 1" stitching points 131 on each of four (4) straps on the top 103 and on each of the two (2) straps 135 on the bottom 104. The outermost two (2) straps on the top 103 form loops 133 for securing the patient 101 in the assembly 100 therein such as with ropes or securing straps. The two (2) innermost rows of straps 135 on the top 103 where the patient 101 is secured align with the two (2) rows of straps 135 on a bottom 104 of the apparatus 100 and these straps 135 are sewn together at stitching points 131 to create loops for securing the patient 101 as well as a handle for use in any situation on the top or the bottom by rescuer(s) 102.

The construction of the straps 135, according to one embodiment, creates forty (40) loops 133 from the stitching points 131 that can provide loops for ropes or a handle for use. According to one embodiment, on the bottom 104 the straps 135 are located as follows: one strap is placed even with each long edge of the base material which will hem the edge, and the remaining 2 straps are placed so that their outside edges are 5" from the outside edge edges of the base material.

Figure 11:
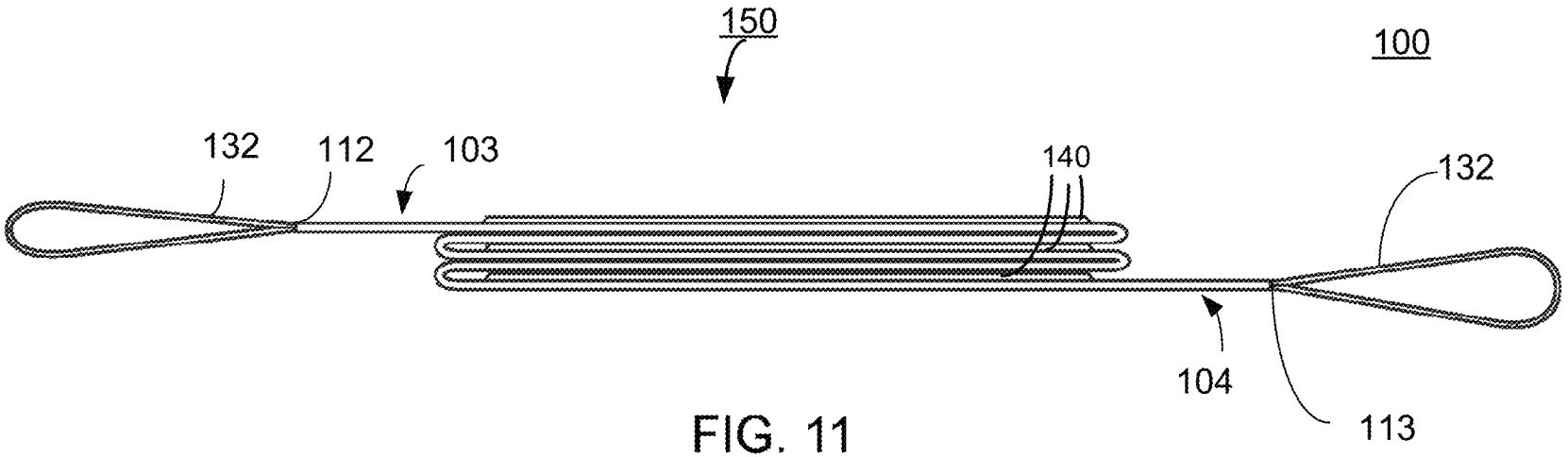
FIG. 11 is a perspective side view illustrating the folding of the fabric and plate construction of the rapid mover apparatus, system and kit in accordance with an embodiment of the present invention.

The rapid mover apparatus and system 100 and kit 160 may be configured to be deployed quickly as shown in FIG. 11 according to an embodiment of the present invention. The sheet assembly 110 may be folded in a pattern (i.e. accordion, "Z" fold configuration where the three plates are stacked evenly with their top surfaces remaining "up" at all times, etc.) configured to be deployed quickly by the person 102 grasping handles 132 while forcing the sheet assembly to uncoil, i.e. tossing forward adjacent the patient 101. Once the sheet assembly 110 is extended adjacent the patient 101 such patient 101 may be moved onto the sheet assembly 110. The patient 101 may be secured within the apparatus 100, e.g. by securing with rope or securing straps 167 attached to one or more loops 133 around the patient 101. The rescuer 102 may then use handles 132, or loops 133, to move the patient 101 from one location to another, e.g. the design according to an embodiment of the present invention accommodates movement by carrying by two (2) or more rescuers 102, or dragging by one (1) rescuer 102. As described herein, the sheet assembly 110 has four (4) rows of straps 135 on the top 103 and two (2) rows on the bottom 104. While preferably the sheet assembly 110 will be oriented with the bottom 104 down and adjacent the ground, the two (2) rows of straps on the bottom 104 align with the straps on the top surface 103 that are affixed there-through by forming one or more stitching points 131. Specifically, the "inside" rows 5" from the edge of the top surface 103 of sheet assembly 110 that function so that if the assembly 110 gets deployed "upside down" then there are still usable strap 135 loops 133 for securing the patient 101.

According to an embodiment of the present invention, for example, the rapid mover apparatus and system 100 and kit 160 can be configured in a predetermined dimension as follows: Dimensions: 80"×36" platform. Folded size: 17"×18½"×1¾"

Weight: Approximately 6 pounds

Base Material: Coated Ballistic Nylon

Imbedded Plate Size: 12" by 16"

Imbedded Plate Material: A semi-rigid plastic between 3/32" and 3/16"

Integral Strap/Handle Material: 2" Nylon strap

Securing Strap Material: 1" Nylon strap

Accessory Strap material: 1" Nylon strap

Accordingly, the assembly and system 100 advantageously features a plurality of plates 140 for protecting the patient 101 from impact injuries during transporting. The plurality of plates 140 function to (1) provide added protection for the patient 101 from bumps when being dragged, (2) allow the rapid mover apparatus 100 to be "tucked" from any angle under the patient; (3) allows for folding and assumes a natural "Z fold" form (4) concept rapid deployment apparatus 100 alongside and then under a patient 101 with little patient 101 movement; and (5) improve portability in the kit 100 that includes multiple sheet assemblies 161, 162, 163, and 164 that is advantageous in many rescuer scenarios.

The assembly and system 100 advantageously features plurality of straps 135 on the top 103 and bottom 104 of the assembly, whereby such straps attached at stitching points 131 form loops 133 with a dual use, e.g. may be used (i) for securing straps and/or (ii) as a handle (forming 40 handles in 2 rows). The assembly and system 100 advantageously features two (2) large handles 132 formed on each end 112, 113 from integral straps 130. The large handles 132 have a construction of being a continuous strap 130 extending along the entire length of the base layer 111 and have structural integrity with the plurality of plates 140 as the straps 130 run the length of the sheet assembly 110 as described herein an shown in FIG. 10. These large handles 132 also are configured for use with a harness 167 of the kit 100 such that an rescuer 102 may transport the patient 101 by dragging as is shown in FIG. 12.

The kit 160 according to the present invention can be configured with a plurality of sheet assemblies 110 rapid mover apparatus and system 100 (i.e. assemblies 161, 162, 163 and 164 in FIG. 13) disposed in a satchel, case or backpack 165. The satchel, case or backpack 165 may be made from nylon. The kit 160 also may be further with a harness 167. The harness 167 may be configured with spring clip attachment hooks at each end to connect to the handles 132 or loops 133 for dragging transporting the patient 101 with the apparatus and system 100. The kit 160 may be formed further with securing straps 168 (e.g. a plurality of securing straps for each assembly). The securing straps 168 may also have spring clip attachment hooks at each end to connect to loops 133 for securing the patient 101 within the apparatus and system 100.

In operation, the rapid mover apparatus and system 100 and kit 160 may be used advantageously by rescuers 102 for the purpose of rapidly moving an injured person from one location to another, either by carrying or dragging the person 101 when they are situated properly on apparatus 100. The apparatus and system 100 and kit 160 may also be used by medical provider persons for moving a person 101 from one surface or location to another, either in emergent or non-emergent situations, for the purpose of providing patient care.

According to an embodiment of the present invention, the rapid mover apparatus and system 100 and kit 160 is designed to be Z-folded "accordion style" into an approximate 19" by 19" by 1.75" size, the z-fold pattern is generally designated as element 150 as shown in FIG. 11. The Z-fold 150 configuration where the three plates 140 are stacked evenly with their top surfaces 103 remaining "up" at all times allows for rapid deploy and placement under the patient 101 (e.g. lying on the ground) with minimal manipulation. The unique Z-fold 150 configuration of the rapid mover apparatus 100 provides for including a plurality of sheet assemblies 161, 162, 163, and 164 in a kit 160 that is ready for use to be deployed from a folded stack under a patient without the plates needing room to flip over or be re-oriented in any way.

In operation, the rapid mover apparatus and system 100 and kit 160 can be deployed in various ways. According to an embodiment of the present invention using the fold 150 pattern, the deployment system 100 may be quickly brought to a location (e.g. site of an emergency) as a single apparatus 100 of a sheet assembly 110 or in a kit containing multiple sheet assemblies 161, 162, 163, and 164. Moreover, once at the site the deployment system 100 may be quickly be (1) deployed, (2) positioned, (3) patient 101 loaded and secured thereon, and (4) transported from one location to another. Examples of the deployment, positioning, loading of the patient 101 and transporting according to the deployment system 100 of present invention are illustrated as follows:

1. On method of deployment is to use the rapid mover apparatus and system 100 in its folded accordion style, then tuck it under the persons 101 head so that the rigid boards stop at approximately the persons shoulders. While holding/grasping the handles 132 aligned towards the patient's 101 feet, the handles 132 are pulled toward the person's feet until the rapid mover apparatus and system 100 is unfolded and positioned under the person.
2. Another method of deployment is to use the rapid mover apparatus and system 100, again folded accordion style, to tuck it under the patient's 101 legs so that the plates 140 stop at approximately the persons 101 buttocks.

While holding/grasping the handles 132 aligned towards the person's 101 head, the handles 132 are pulled toward the person's feet until the rapid mover apparatus and system 100 is unfolded and positioned under the person.

3. Another method of deployment is to use the rapid mover apparatus and system 100, again folded accordion style, to tuck it under the patient's 101 back so that the plates 140 stop at approximately the person's 101 waist. While holding/grasping the handles 132 aligned towards the person's 101 head, the handles 132 (e.g. end 112) are pulled toward the person's head until the rapid mover apparatus and system 100 is one-half (½) unfolded. While holding/grasping the handles 132 (e.g. end 113) aligned towards the person's 101 feet, the handles 132 are pulled until the remaining ½ of the rapid mover apparatus and system 100 is unfolded and is positioned under the person.
4. According to yet another method of deployment, rapid mover apparatus and system 100 is unfolded entirely adjacent next to the person 101. The rescuer 102 will roll the person 101 away from the apparatus and system 100 and tuck rapid mover apparatus and system 100 under the person 101 as far as possible. Using the plates 140 to help guide the apparatus and system 100 the person 101 is rolled back onto apparatus and system 100 and repositioned as necessary.

Once a person is positioned on the rapid mover apparatus and system 100, the person 101 is secured using any means such as adjustable strap 168 that advantageously may be connected via locking clip or carabineer. The securing straps 168 can be clipped between or woven through any two rows of the loops 133 locations and may be made adjustable.

Once a person is secured in the rapid mover apparatus 100, the rescuer 102 can move the patient 101 by either carrying or dragging. According to an embodiment of the invention involving carrying, the two (2) or more rescuer(s) (e.g. two or more first responders) can lift and carry the rapid mover apparatus 100 using any of the handles 132 of the integral straps 130 and/or loops 133 of the securing straps 135. According to an embodiment of the invention involving dragging, one (1) rescuer 102 (e.g. a first responder) can drag the rapid mover apparatus by attaching a harness 134 included with the system and kit 100, or another rescue rope or strap, to any of the loops 133 located at either end of the rapid mover apparatus 100. The plates 140 are designed to provide protection to the patient 101 when the rapid mover apparatus 100 is dragged over rough or jagged surfaces by a "ramping" action, deflecting impacts.

There is a long-felt commercial need for a rapid mover apparatus and system 100 and kit 160. The rapid mover apparatus and system 100 may be purchased in individual sheet assemblies 110 and manufactured in a cost-effective manner. The kit 160, without limiting its application, advantageously satisfies a need for a response pack and, according to one embodiment, may be configured as a plurality of sheet assemblies 161, 162, 163 and 164 of the apparatus and system 100 in a backpack 165. The backpack 165 can be configured to contain four (4) sheet assemblies 161, 162, 163 and 164 of the same predetermined dimension (i.e. adult) or contain varying dimensions, for example, each pack can contain three (3) sheet assemblies 161, 162, and 163 of the same predetermined dimension (i.e. adult), one (1) or more sheet assemblies 164 units in a smaller predetermined dimension (i.e. child, animal, etc.). Moreover, the kit 160 according to the present invention may be configured as quantities of the sheet assemblies 161, 162, 163 and 164 varied by different sizes and quantities in the backpack 165 with drag harness 166, securing straps 167, and additional trauma supplies 168.

While certain configurations of structures have been illustrated for the purposes of presenting the basic structures of the present invention, one of ordinary skill in the art will appreciate that other variations are possible which would still fall within the scope of the appended claims. For example, the above-identified specifications and dimensions are non-limiting as it is contemplated that different sizes of the rapid mover apparatus and system 100 and kit 160 will be useful for different dimensions of persons—from children to adults to larger adults—can be used in the field. Moreover, packs of the kit 160 can be configured with multiple assemblies and various dimensions of the rapid mover apparatus and system 100 to be well equipped respond to events and have appropriate gear in the field. Advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An apparatus for moving a non-ambulatory person, comprising:

a sheet assembly for enclosing the non-ambulatory person, said sheet assembly having a generally rectangular shape with sides and ends, said sheet assembly comprising:

a base layer, an upper layer, one or more integral straps, said one or more integral straps disposed between said base and upper layers on an interior surface, said one or more integral straps aligned parallel with the sides of said sheet assembly and spaced apart from an adjacent side of said sides of said sheet assembly, whereby a handle is formed adjacent each end of said sheet assembly, said handle formed from each end of said one or more integral straps, a plurality of rigid plates, said plurality of rigid plates disposed between said base and upper layers, each of said plates spaced apart from an adjacent side and end of said sides and ends of said sheet assembly, each of said plates has an edge that aligns with a longitudinal axis of said one or more integral straps, whereby a plurality of first stitching points and seams join said plates and one or more integral straps within said base and upper layers, and two or more securing straps, said two or more securing straps being located on an exterior surface of each said base and upper layers, said two or more securing straps being aligned with each other and spaced apart from an adjacent side of said sides of said sheet assembly on said exterior surfaces of said base and upper layers, whereby a plurality of second stitching points join said two or more securing straps to said base and upper layers forming a plurality of loops.

2. The apparatus of claim 1, wherein said base layer and said upper layer are each configured from sheets of fabric of a generally rectangular shape.

3. The apparatus of claim 1, wherein said base layer is formed from sheets of fabric with a coated surface forming a liquid barrier.

4. The apparatus of claim 1, wherein said base layer is formed from sheets of fabric comprising ballistic nylon fabric material.

5. The apparatus of claim 1, wherein said base layer is formed from sheets of fabric comprising 1050 Denier Coated Ballistic Nylon.

6. The apparatus of claim 1, wherein said upper layer is formed from sheets of fabric with a coated surface forming a liquid barrier.

7. The apparatus of claim 1, wherein said upper layer is formed from sheets of fabric comprising ballistic nylon fabric material.

8. The apparatus of claim 1, wherein said upper layer is formed from sheets of fabric comprising 1050 Denier Coated Ballistic Nylon.

9. The apparatus of claim 1, wherein said one or more integral straps is formed from nylon tape.

10. The apparatus of claim 1, wherein said two or more securing straps are formed from nylon tape.

11. The apparatus of claim 1, wherein said plurality of rigid plates comprise rigid materials of a predetermined dimension.

12. The apparatus of claim 1, wherein said plurality of rigid plates comprise metallic or plastic materials.

13. The apparatus of claim 1, wherein said plurality of rigid plates comprise polypropylene copolymer material.

14. The apparatus of claim 1, wherein said plurality of rigid plates comprises plates formed in a predetermined dimension of approximately 0.125" thickness, width of twelve inches (12"), and length of sixteen inches (16").

15. An evacuation system for transporting a non-ambulatory person from one location to another comprising:

a RPM assembly having a generally rectangular shape with sides, a head end, and a foot end, folded in a Z-fold pattern for improved deployment, said Z-Folded RPM assembly configured to be located at a predetermined position relative the non-ambulatory person said RPM assembly comprising, a base layer, an upper layer, two or more integral straps, a plurality of rigid plates, and two or more securing straps, wherein said base layer and said upper layer are each configured from sheets of fabric of a generally rectangular shape, said two or more integral straps disposed between said base and upper layers on an interior surface, said two or more integral straps each aligned with an adjacent side of said sides of said RPM assembly and spaced apart between said base and upper layers, whereby handles are formed adjacent each end of said RPM assembly, said handles formed from each end of two or more integral straps, said plurality of rigid plates disposed between said base and upper layers, each of said plurality of rigid plates spaced apart a predetermined dimension along a length of said base and upper layers, each of said plurality of rigid plates has two or more edges that each align with a longitudinal axis of one of said two or more integral straps, whereby a plurality of first stitching points and seams join said plurality of rigid plates and said two or more integral straps within said base and upper layers;

said two or more securing straps being located on an exterior surface of each said base and upper layers, said two or more securing straps being aligned with each other and spaced apart along a width of each of said base and upper layers on a respective said exterior surface thereof, whereby a plurality of second stitching points join said two or more securing straps to said base and upper layers forming a plurality of loops, wherein said RPM assembly unfolds using said handles to position the RPM assembly unfolded under the non-ambulatory person.

16. The evacuation system of claim 15, wherein said RPM assembly is intended to be used by placing the RPM assembly adjacent a head of said non-ambulatory person and to, tuck said RPM assembly under said head so as to orient said plurality of plates at approximately said non-ambulatory person's shoulders, whereby said RPM assembly is unfolded under said non-ambulatory person by pulling said handles of said two or more integral straps aligned with and towards feet of said non-ambulatory person until said RPM assembly is unfolded and positioned under said non-ambulatory person.

17. The evacuation system of claim 15, wherein said RPM assembly is intended to be used by placing the RPM assembly adjacent a leg(s) of said non-ambulatory person and to, tuck said RPM assembly under said leg(s) so as to orient said plurality of plates at approximately said non-ambulatory person's buttocks, whereby said RPM assembly is unfolded under said non-ambulatory person by pulling said handles of said two or more integral straps aligned with and towards a head of said non-ambulatory person until said RPM assembly is unfolded and positioned under said non-ambulatory person.

18. The evacuation system of claim 15, wherein said RPM assembly is intended to be used by placing the RPM assembly adjacent a back of said non-ambulatory person and to, tuck said RPM assembly under said back so as to orient said plurality of plates at approximately said non-ambulatory person's waist, whereby said RPM assembly is unfolded in a manner by pulling said handles of said two or more integral straps aligned with and towards a head of said non-ambulatory person until said RPM assembly is one-half unfolded, and by pulling said handles aligned with and towards feet of said non-ambulatory person until said RPM assembly is completely unfolded and positioned under said non-ambulatory person.

19. The evacuation system of claim 15, wherein said RPM assembly is intended to be used by unfolding the RPM assembly adjacent said non-ambulatory person, whereby said non-ambulatory person is then rolled away from said RPM assembly, using said plurality of rigid plates said RPM assembly is repositioned and tucked under said non-ambulatory person, said non-ambulatory person being roiled back onto said RPM assembly with said RPM assembly positioned under said non-ambulatory person.

* * * * *